US009943908B2

(12) United States Patent
Ferrer

(10) Patent No.: US 9,943,908 B2
(45) Date of Patent: *Apr. 17, 2018

(54) METHOD FOR INCORPORATING ABRADABLE MATERIAL INTO A HOUSING BY ISOSTATIC PRESSING

(71) Applicant: Safran Aircraft Engines, Paris (FR)

(72) Inventor: Laurent Ferrer, Lieusaint (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 468 days.

This patent is subject to a terminal disclaimer.

(21) Appl. No.: 14/433,586

(22) PCT Filed: Sep. 30, 2013

(86) PCT No.: PCT/FR2013/052316

§ 371 (c)(1),
(2) Date: Apr. 3, 2015

(87) PCT Pub. No.: WO2014/053754

PCT Pub. Date: Apr. 10, 2014

(65) Prior Publication Data

US 2015/0266093 A1 Sep. 24, 2015

(30) Foreign Application Priority Data

Oct. 5, 2012 (FR) ..... 12 59511

(51) Int. Cl.
*B22F 3/15* (2006.01)
*B22F 5/00* (2006.01)
(Continued)

(52) U.S. Cl.
CPC ..... *B22F 3/15* (2013.01); *B22F 3/12* (2013.01); *B22F 3/24* (2013.01); *B22F 5/009* (2013.01);
(Continued)

(58) Field of Classification Search
CPC ..... B22F 5/10; B22F 3/12; B22F 5/009
See application file for complete search history.

(56) References Cited

U.S. PATENT DOCUMENTS 3,975,165 A * 8/1976 Elbert ..... B32B 18/00 264/113
9,737,932 B2 * 8/2017 Ferrer ..... B22F 3/18
(Continued)

FOREIGN PATENT DOCUMENTS

| | | | |
|---|---|---|---|
| JP | 01149904 A | * | 6/1989 |
| JP | H 0717929 B | | 3/1995 |
| WO | WO 2014/053752 | | 4/2014 |
| WO | WO 2014/053754 | | 4/2014 |
| WO | WO 2014/053761 | | 4/2014 |

OTHER PUBLICATIONS

Examination Report dated Mar. 30, 2016, in corresponding Great Britain Patent Application No. GB1507630.0 (4 pages).
(Continued)

*Primary Examiner* — Colleen P Dunn
*Assistant Examiner* — Rajinder Bajwa
(74) *Attorney, Agent, or Firm* — Bookoff McAndrews, PLLC

(57) ABSTRACT

A method of fabricating a part (10) having a housing (20) that includes an opening (25) opening out in a free surface (15) of the part (10). The method comprises the following steps:

(a) closing the opening (25) with a sheath (30), the sheath having a vacuum orifice (31) and a filling orifice (32);
(b) filling the housing (20) with an abradable material (50) constituted by particles by using the filling orifice (32), and evacuating the housing (20) using the vacuum orifice (31);
(c) closing the orifices (31, 32) in leaktight manner;
(d) deforming the sheath (30) so as to compress the abradable material (50) in the housing (20) and heating
(Continued)

the abradable material (50) to a temperature higher than 150° C. so that the abradable material (50) becomes sintered; and (e) subsequently lowering the temperature and the pressure.

7 Claims, 2 Drawing Sheets

(51) Int. Cl.
*B22F 7/08* (2006.01)
*B22F 3/12* (2006.01)
*B22F 3/24* (2006.01)

(52) U.S. Cl.
CPC ..... *B22F 7/08* (2013.01); *B22F 2003/247* (2013.01); *F05D 2230/22* (2013.01)

(56) References Cited

U.S. PATENT DOCUMENTS

2004/0261690 A1* 12/2004 Ivy ..... C30B 11/00 117/81
2007/0092394 A1* 4/2007 Groh ..... B22F 3/15 419/68
2009/0297331 A1 12/2009 Caucheteux et al.
2012/0032404 A1 2/2012 Seib et al.

OTHER PUBLICATIONS

International Search Report dated Jan. 17, 2014, in corresponding PCT Application No. PCT/FR2013/052316 (2 pages).

* cited by examiner

METHOD FOR INCORPORATING ABRADABLE MATERIAL INTO A HOUSING BY ISOSTATIC PRESSING

This application is the U.S. national phase entry under 35 U.S.C. § 371 of International Application No. PCT/FR2013/052316, filed on Sep. 30, 2013, which claims priority to French Patent Application No. FR 1259511, filed on Oct. 5, 2012, the entireties of each of which are incorporated by reference herein.

FIELD OF THE INVENTION

The present invention relates to a fabrication method for fabricating a part having a housing with an opening opening out in a free surface of the part, the housing being for receiving an abradable material.

STATE OF THE PRIOR ART

Numerous machines include parts that move relative to parts that are stationary. It is desired to minimize air or gas leakages that exist between the stationary parts and the moving parts in such a machine, since they lead to a loss of performance.

For example, machines are known which comprise a part (rotor) that rotates about an axis and that has a portion rubbing against a stationary part (stator). This applies to a turbomachine in which the moving blades rub during their rotary motion against the inside face of the casing, which is stationary.

In a turbomachine, it is important to minimize the leakages of gas that exist between the stationary portions and the rotating portions of the turbomachine, since such leakages reduce the flow rate of the stream of compressed air through the turbomachine and consequently cause a fraction of the useful mechanical work to be lost. Consequently, this has a direct impact on the efficiency of the turbomachine, on its fuel consumption, and on the thrust that it produces. Such leakages are a consequence of the need to take account of geometrical tolerances between the stationary portions and the rotating portions and also to take account of thermal expansion and creep of these portions in operation.

In order to minimize such leakages, the currently used solution consists in bringing the blades as close as possible to the casing, while installing a soft material in a housing in the casing, in register with the blades. The soft material is abradable, which means that it has the property of allowing the tip of a blade to dig into the material easily in the event of contact. In certain circumstances, this material presents wear-inducing properties, and can sometimes serve to polish the tips of the blades. Thus, the blades are practically undamaged when they rub against the abradable material, and the space between the tips of the blades and the inside surface of the casing is kept to a minimum.

In the description below, the terms "inside" and "outside" relate respectively to the regions inside and outside the housing in the part.

At present, abradable material portions are fabricated by sintering, and then these portions are assembled and fitted inside the housing, with these portions being bonded within the housing so as to form a layer that fills the housing.

That method of fabrication is lengthy and expensive. In addition, the stresses generated during the fabrication of the portions of abradable material and while they are being bonded contribute to these portions separating from the surface of the housing in the part, and/or to premature cracking and deterioration of these portions in operation.

The present invention seeks to remedy those drawbacks.

SUMMARY OF THE INVENTION

The invention seeks to propose a method that enables the abradable material to adhere well to the wall of the housing, and that provides good mechanical adhesion for the abradable material so that separation does not occur at the interface between the block of abradable material and the wall of the housing and so that premature cracking or damage does not occur within the block of abradable material.

This object is achieved by the fact that the method comprises the following steps:

(a) closing the opening with a sheath, the sheath having a vacuum orifice and a filling orifice;

(b) evacuating the housing using the vacuum orifice and using the filling orifice to fill the housing with an abradable material constituted by particles;

(c) closing the vacuum orifice and the filling orifice in leaktight manner;

(d) deforming the sheath so as to compress the abradable material in the housing, and heating the abradable material to a temperature higher than 150° C. so that the particles of the abradable material become sintered together; and (e) subsequently lowering the temperature and the pressure to ambient temperature and ambient pressure respectively, and removing the sheath.

By means of these provisions, the particles constituting the abradable material are better compacted and they have better cohesion.

In certain implementations, in step (d), the following steps are performed:

(k1) heating the abradable material until all points therein are at a temperature T1 higher than 150° C., while exerting isostatic compression on the sheath so that it exerts a pressure P on the sheath; and (k2) maintaining the pressure P and the temperature T1 until all of the particles of the abradable material become sintered.

In certain implementations, in step (d), the following steps are performed:

(m1) heating the abradable material until all of the points therein are at a temperature T2 lying in the range 150° C. to 500° C.;

(m2) maintaining the abradable material part at said temperature T2 and placing around the sheath a rigid enclosure filled with an incompressible fluid, and then compressing the fluid in such a manner that the fluid exerts a pressure P on the sheath; and (m3) maintaining said pressure P and heating said abradable material to a temperature T3 higher than the temperature T2 until all of the particles of the abradable material are sintered.

The invention will be well understood and its advantages will better appear on reading the following detailed description.

BRIEF DESCRIPTION OF THE DRAWINGS

The detailed description refers to the accompanying drawings, in which.

DETAILED DESCRIPTION OF IMPLEMENTATIONS

Figure 1A:
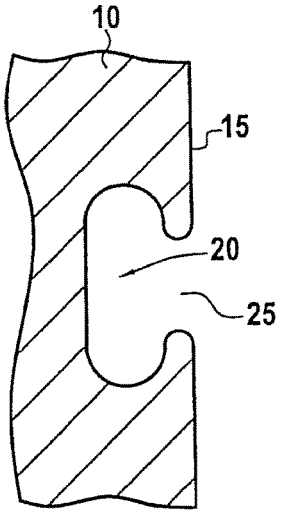
FIG. 1A shows a part prior to step (a) of the method of the invention.

Implementations are described in detail below with reference to the accompanying drawings. These implementations show the characteristics and advantages of the invention. It should nevertheless be recalled that the invention is not limited to these implementations.

An abradable material 50 is provided that is constituted by a set of particles. The term "particle" is used to mean an element that may be in the form of a substantially spherical grain, or more elongate in shape in one dimension (fibers), or in two dimensions (flakes). Most or all of these particles are of sinterable material, i.e. a material that is suitable for diffusing from one particle to an adjacent particle when the particles are kept in contact with one another at a high temperature for a certain amount of time, such that bonds are created between the particles. The material is then sintered.

During sintering, the material constituting the particles does not melt.

In a sintered material, it is thus possible for pores to remain.

If the material is compacted and raised to even higher temperatures, pores disappear progressively. The compacting operation also makes it possible to deform the particles.

The abradable material 50 may also have particles (organic, inorganic, metallic, intermetallic, . . . ) that transform in order to form bubbles of gas or that present poor adhesion by diffusion. As a result, such particles make it easier to detach pieces of abradable material when moving elements pass by so as to better reduce clearance between those elements and the abradable surface against which the elements rubs.

A part 10 is provided having one or more housings 20. This or these housings 20 are cavities formed in the part 10 and that open out to a free surface 15 of the part 10. These housings 20 may for example be grooves, or recesses.

A housing 20 thus has at least one opening 25 in an outside surface of the part. This opening 25 is continuous. It may also be discontinuous, i.e. made up of a plurality of sub-openings.

The part 10 is in its final or almost final shape.

The term "final shape" is used to mean a part that has already been shaped and machined as close as possible to its final dimensions.

The term "semi-final shape" is used to mean a part that has been shaped, but prior to being machined as close as possible to its final dimensions.

In the present implementation, this part 10 is a turbomachine casing, and the movable elements are blades. Nevertheless, the invention applies to any part 10 having at least one housing 20 as described above.

Such a part (casing) 10 is shown in section in FIG. 1A. The free surface 15 into which the opening 25 of the housing 20 opens out is the radially inner face of the casing 10, which is a shroud centered on an axis.

The housing 20 is a dovetail-shaped groove that extends in a direction perpendicular to the section plane.

The housing 20 may also be of any shape.

The maximum section of the housing 20 in a plane parallel to the free surface 15 may be at a non-zero distance from the free surface 15. For example, the bottom of the housing 20 (i.e. its portion furthest from the free surface 15) presents a maximum section. Thus, the housing 20 presents at least one converging portion on going towards the opening 25. As a result, the abradable material 25 that fills the housing 20 (see below), once it constitutes a single-piece block, is held mechanically in the housing 20.

Figure 1B:
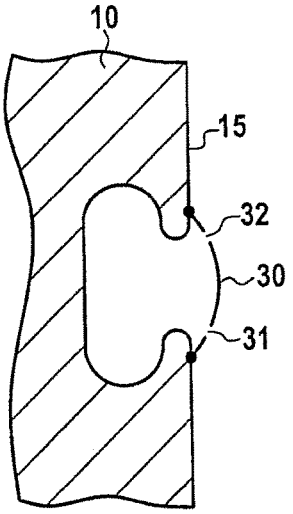
FIG. 1B shows a part after step (a) of the method of the invention.

The opening 25 is closed with a sheath 30 (step (a) of the method). FIG. 1B shows this step.

The sheath 30 is made of a material that is sufficiently flexible or ductile and has a thickness that is sufficiently small to enable it to deform under the effect of the pressure P that is applied thereto during a subsequent step at a certain temperature and for a certain duration (see below). The sheath 30 closes the opening 25 in leaktight manner with the exception of a vacuum orifice 31 and a filling orifice 32.

By way of example, the edges of the sheath 30 are fastened in leaktight manner to the free surface 15 around the entire periphery of the opening 25.

By way of example, this fastening is performed by welding.

Thus, the sheath presents a vacuum orifice 31 and a filling orifice 32. One and/or both of these orifices may be continuous or discontinuous, i.e. made up of a plurality of disjoint sub-orifices.

The housing 20 is filled with the abradable material 50 by using the filling orifice 32, with a vacuum being established inside the housing 20 via the vacuum orifice 31 (step (b) of the method). By way of example, the housing 20 is filled initially, and then it is evacuated. Alternatively, the housing 20 is filled and evacuated simultaneously.

The fact that the abradable material 50 is in the form of a set of disjoint particles makes such a filling operation possible.

The filling may be performed simultaneously with creating a vacuum in the housing 20, thereby reducing the total duration of the method.

Figure 1C:
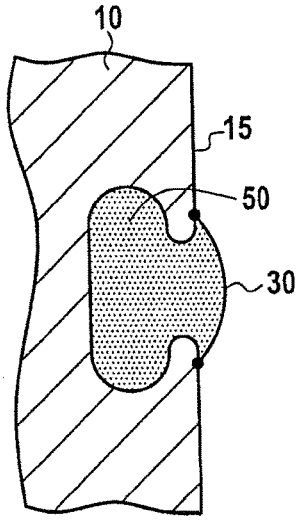
FIG. 1C shows a part after steps (b) and (c) and prior to step (d) of the method of the invention.

Once the housing 20 is completely filled with abradable material 50, the vacuum orifice 31 and the filling orifice 32 are closed in leaktight manner, such that the housing 20 is closed in leaktight manner (step (c) of the method). FIG. 1C shows this step.

The volume defined by the wall of the housing 20 and by the sheath 30, referred to as the initial volume, is strictly greater than the volume of the housing 20, the volume of the housing 20 being defined by the wall of the housing 20 and a plane that is situated extending the free surface 15 into which the opening 25 opens out.

Figure 1D:
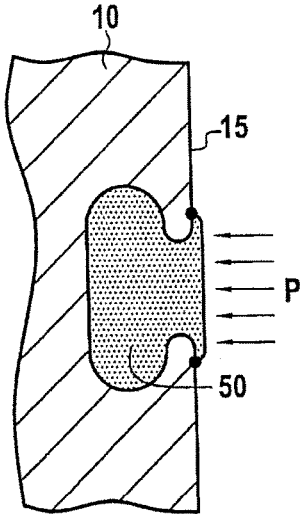
FIG. 1D shows a part after step (d) of the method of the invention.

Thereafter, a pressure P that is greater than atmospheric pressure is applied against the outer face of the sheath 30. The sheath 30 thus deforms under the effect of unidirectional stress acting normally to its surface, and the sheath 30 subjects the abradable material 50 to deformation in the housing 20 (the abradable material 50 being stressed by the wall of the housing 20), while heating the abradable material 50 to a temperature higher than 150° C. so as to cause the particles of the abradable material 50 to sinter (step (d) of the method). FIG. 1D shows this step.

After step (d), the abradable material 50 is sintered and occupies a volume (referred to as the final volume) that is less than the initial volume, as a result of the compacting and sintering that has taken place between the particles of the abradable material 50.

Thereafter the temperature and the pressure are lowered to ambient temperature and ambient pressure, respectively, and the sheath 30 is withdrawn (step (e) of the method).

The final volume may be greater than the volume of the housing 20. Consequently, the abradable material 50 may form a swelling beyond the free surface 15. In this way, the space between a blade having its tip close to the free surface 15 and the surface 55 of the abradable material 50 in the opening 25 is minimized. The surface 55 is the free surface of the abradable material looking to the outside of the part 20 (and when the part 10 is a casing, the surface 55 looks into the space inside the casing).

After step (e), the surface 55 of the abradable material 50 may be machined near the opening 25 so that the surface 55, once machined, lies substantially flush with the free surface 15 of the part 10.

Figure 1E:
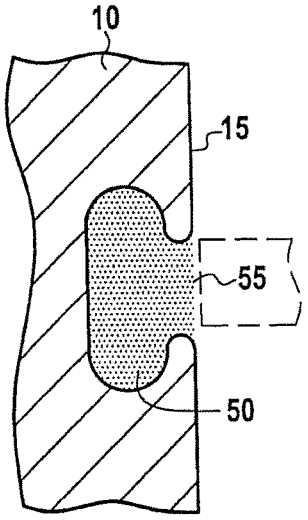
FIG. 1E shows a part after steps (e) and (f) of the method of the invention.

FIG. 1E shows this step (step (f) of the method).

Thus, a blade (drawn in dashed lines in FIG. 1E) is positioned so that its tip rubs against the surface 55 and the leakage of gas past the tip of the blade is minimized.

For example, once it has been machined, the surface 55 may be flush with the free surface 15.

In a variant, the housing 20 is filled with a plurality of layers of abradable materials 50, each layer being of a kind that is different from the adjacent layer.

Two layers are said to be different kinds when a layer constituted by one material differs from another layer, or a layer constituted by a mixture of several materials differs from another layer constituted by a mixture of the same materials, but with different proportions. The layers therefore do not present the same properties.

Figure 2:
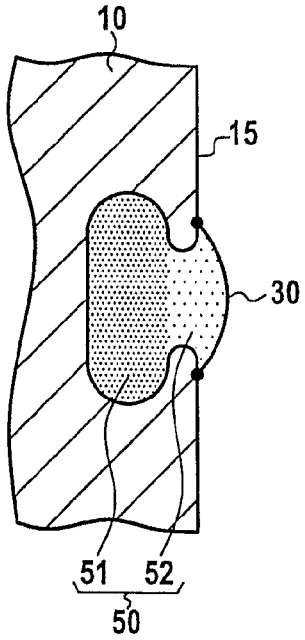
FIG. 2 shows a part after steps (e) and (f) in a variant of the method of the invention

This situation is shown in FIG. 2 for two layers. A portion of the housing 20 is initially filled with a first abradable material 51 that forms a first layer, and then the remainder of the housing 20 is filled with a second abradable material 52 that forms a second layer.

In a first implementation, in step (d), the following steps are performed:

(k1) heating the abradable material 50 until all points therein are at a temperature T1 higher than 150° C., while exerting isostatic compression on the sheath 30 so that it exerts a pressure P on the sheath 30; and (k2) maintaining the pressure P and the temperature T1 until all of the particles of the abradable material 50 are sintered and compacted.

These steps (k1) and (k2) constitute hot isostatic compression.

The duration of step (k2) may be short, less than 5 minutes, or even equal to zero since the sintering of all of the particles of the abradable material 50 may have taken place during the temperature rise of step (k1).

For example, in order to exert isostatic compression on the abradable material 50, the assembly constituted by the part 10, the sheath 30, and the abradable material 50 is placed in a gas-filled enclosure. This method presents the advantage that the part 10 suffers practically no deformation during the method of the invention.

The temperature T1 may be higher than the temperature at which a maximum number of pores in the abradable material 50 are resorbed.

There therefore remain fewer pores within the abradable material 50. Consequently, the resilience of the abradable material 50 is improved.

In addition, the residual stresses within the abradable material 50 are smaller and the solidity of the abradable material 50 is improved.

Furthermore, in the housing 20, adhesion between the particles of abradable material 50 and the surface of the wall of the housing 20 is improved. As a result, less separation of the abradable material 50 is thus observed subsequently.

The filling of the housing 20 by the particles of abradable material 50 is also more effective, thus making it possible for the housing 20 to be of complex shape with indentations and projections. Adhesion in use between the wall of the housing 20 and the abradable material is also improved.

By way of example, the temperature T1 is higher than 500° C.

When the part 10 comprises a first solid continuous portion made of a first material and a second portion made of a distinct material, the second portion initially being in the form of a powder for securing with the first portion by hot isostatic compression, it is possible to perform the hot isostatic compression of this second portion simultaneously with the hot isostatic compression of the abradable material 50.

The housing 20 is then situated in the first portion of the part 10.

By performing these two isostatic compression operations simultaneously, fabrication time is shortened.

For example, the part 10 may be a casing, the first portion may be made of steel, and the second portion may initially be a titanium alloy powder that constitutes, after isostatic compression, a continuous solid portion made of titanium alloy.

In a second implementation of the invention, in step (d), the following steps are performed:

(m1) heating the abradable material 50 until all of the points therein are at a temperature T2 lying in the range 150° C. to 500° C.;

(m2) maintaining said abradable material 50 at said temperature T2 and placing around said sheath 30 a rigid enclosure 60 filled with an incompressible fluid 65, and then compressing the fluid 65 in such a manner that the fluid 65 exerts a pressure P on the sheath 30; and (m3) maintaining said pressure P and heating said abradable material 50 to a temperature T3 higher than the temperature T2 until all of the particles of said abradable material 50 are sintered and compacted.

Steps (m1) and (m2) constitute warm hydroforming.

The duration of step (m3) may be short, less than 5 minutes, or even equal to zero, since all of the particles of the abradable material 50 may be sintered during the rise in temperature of step (m1) or of steps (m1) and (m2).

The rigid enclosure is more rigid than the sheath 30 so that the sheath 30 deforms during the method.

The part 10 may be placed in a rigid mold 70 that does not cover the enclosure 60, such that the deformation of the part 10 during steps (m2) and (m3) is minimized.

The mold 70 is more rigid than the part 10.

Figure 3:
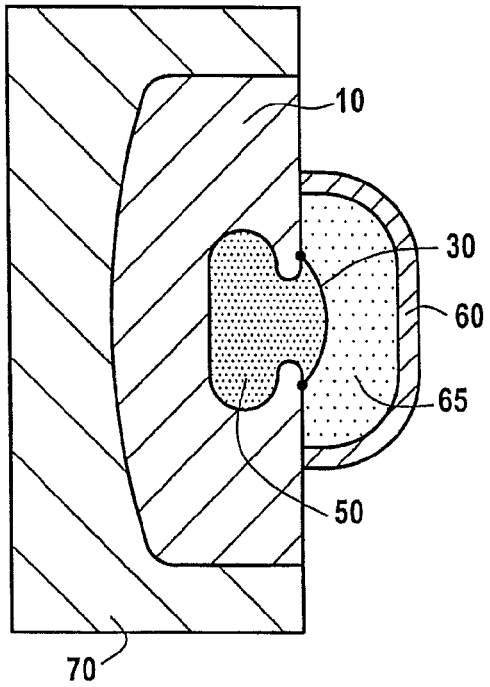
FIG. 3 shows a part prior to step (d) of the method in a second implementation of the invention.

This method is shown in FIG. 3.

In this second implementation, the abradable material 50 is sintered (step (m3)) more effectively (better compacting of the particles and fewer residual pores, and better cohesion of the particles), and more quickly compared with the methods of the prior art because of the prior heating and because of the compression of the abradable material 50 (steps (m1) and (m2)).

In addition, in the housing 20, the adhesion of the particles of abradable material 50 to the surface of the wall of the housing 20 is improved. As a result, less separation of the abradable material 50 is observed subsequently.

The temperature T3 may be higher than the temperature at which a maximum number of pores in the abradable material 50 are resorbed.

There therefore remain fewer pores within the abradable material 50. Consequently, the impact strength of the abradable material 50 is improved.

Furthermore, residual stresses within the abradable material 50 are smaller and the solidity of the abradable material 50 is improved.

The filling of the housing 20 with the particles of abradable material 50 is also more effective, thus making it possible to use a housing 20 of complex shape with indentations and with projections.

For example, the temperature T3 may be higher than 500° C.

For a part 10 comprising a solid continuous first portion made of a first material and a second portion made of a distinct second material, the second portion initially being at least in part in the form of a powder and being for securing to the first portion by warm hydroforming followed by sintering, it is possible to perform the warm hydroforming followed by sintering on said second portion simultaneously with warm hydroforming followed by sintering of the abradable material 50.

By performing these two warm hydroforming operations simultaneously, application time is shortened.

By way of example, the part 10 may be a casing, the first portion may be made of steel, and the second portion may initially be a titanium alloy powder, that forms, at the end of warm hydroforming followed by sintering, a continuous solid portion made of titanium alloy.

For example, the part 10 is a casing, the first portion is constituted by one or more materials, and the second portion is a layer of composite material constituted by titanium fibers in a matrix in powder form.

At the end of the warm hydroforming followed by sintering, the second portion forms a continuous solid portion that is reinforced by titanium fibers.

The implementations described in the present description are given purely by way of non-limiting illustration, and a person skilled in the art can easily, in the light of this description, modify these implementations or envisage others, while remaining within the ambit of the invention.

Furthermore, the various characteristics of these implementations may be used singly or they may be combined with one another. When they are combined, these characteristics may be combined as described above, or in other ways, the invention not being limited to the specific combinations described in the present description. In particular, unless specified to the contrary, a characteristic described with reference to any one implementation may be applied in analogous manner to another implementation.

The invention claimed is:

1. A fabrication method for fabricating a part comprising an abradable material, the method comprising providing a part having a housing with an opening opening out in a free surface of said part, said housing being for receiving an abradable material, and subsequently carrying out the following steps:

(a) closing said opening with a sheath, said sheath having a vacuum orifice and a filling orifice;

(b) using said filling orifice to fill said housing with an abradable material constituted by particles, and evacuating said housing using said vacuum orifice;

(c) closing said vacuum orifice and said filling orifice in leaktight manner;

(d) deforming said sheath so as to compress said abradable material in said housing, and heating said abradable material to a temperature higher than 150° C. so that the particles of said abradable material become sintered together; and (e) subsequently lowering the temperature and the pressure to ambient temperature and ambient pressure respectively, and removing said sheath.

2. A fabrication method according to claim 1, wherein, after step (e), the following step (f) is performed:

(f) machining the surface of said abradable material in said opening in such a manner that said surface once machined lies substantially flush with said free surface of the part.

3. A fabrication method according to claim 1, wherein, in step (b), said housing is filled with a plurality of layers of abradable materials, each layer being different in kind from an adjacent layer.

4. A fabrication method according to claim 1, wherein in step (d), the following steps are performed:

(k1) heating the abradable material until all points therein are at a temperature T1 higher than 150° C., while exerting isostatic compression on said sheath so that it exerts a pressure P on said sheath; and (k2) maintaining said pressure P and said temperature T1 until all of the particles of said abradable material become sintered.

5. A fabrication method according to claim 4, wherein said temperature T1 is higher than the temperature at which a maximum number of pores in said abradable material are resorbed.

6. A fabrication method according to claim 1, wherein, in step (d), the following steps are performed:

(m1) heating the abradable material until all of the points therein are at a temperature T2 lying in the range 150° C. to 500° C.;

(m2) maintaining said part at said temperature T2 and placing around said sheath a rigid enclosure filled with an incompressible fluid, and then compressing the fluid in such a manner that the fluid exerts a pressure P on said sheath; and (m3) maintaining said pressure P and heating said abradable material to a temperature T3 higher than the temperature T2 until all of the particles of said abradable material are sintered.

7. A fabrication method according to claim 6, wherein said temperature T3 is higher than the temperature at which a maximum number of pores in said abradable material are resorbed.

* * * * *